US006294747B1

(12) United States Patent
Liu et al.

(10) Patent No.: US 6,294,747 B1
(45) Date of Patent: Sep. 25, 2001

(54) INSPECTION MACHINE FOR SURFACE MOUNT PASSIVE COMPONENT

(75) Inventors: Donald Liu, San Diego; Denver Braden, San Marcos; Romulo V. de Vera, San Diego; Malcolm Vincent Hawkes, Escondido, all of CA (US)

(73) Assignee: Electro Scientific Industries, Inc., Portland, OR (US)

( * ) Notice: Subject to any disclaimer, the term of this patent is extended or adjusted under 35 U.S.C. 154(b) by 0 days.

(21) Appl. No.: 09/578,787

(22) Filed: May 23, 2000

Related U.S. Application Data

(63) Continuation-in-part of application No. 09/324,273, filed on Jun. 2, 1999, now abandoned.

(51) Int. Cl.[7] ..... B07C 5/344

(52) U.S. Cl. ..... 209/574; 576/643; 576/919

(58) Field of Search ..... 209/571, 574, 209/576, 577, 621, 643, 919, 925; 198/689.1

(56) References Cited

U.S. PATENT DOCUMENTS 4,354,602 * 10/1982 Miyoshi et al. ..... 209/919 X
6,025,567 * 2/2000 Brooks ..... 209/574

FOREIGN PATENT DOCUMENTS

427611 * 5/1991 (EP) ..... 209/919
2590811 * 6/1987 (FR) ..... 209/919
2-193813 * 7/1990 (JP) ..... 209/919

* cited by examiner

*Primary Examiner*—Tuan N. Nguyen
(74) *Attorney, Agent, or Firm*—John J. Murphey, Esq.

(57) ABSTRACT

This invention is a visual inspection machine for a surface mount passive component (chip) made up of a rotating circular loader wheel inclined to the horizontal and including an upper exposed wheel surface against which an inventory of chips is placed for loading and a rim in which a plurality of cavities, of a size and shape to accept a single chip therein in an upright position, are formed, each cavity defined by a pair of spaced-apart cavity side walls, a rear cavity wall, and having a corner chamfer leading down thereinto from the wheel surface located on the side wail of the cavity in the direction of rotation of the loader wheel, a first vacuum station connected to the loader wheel for providing vacuum power in each cavity for retaining each chip in a cavity for a first inspection, a first inspection station, external the loader wheel, for viewing a first side surface of the chip during its location in the cavity on the loader wheel, a transfer wheel defined by an outer marginal edge, the wheel arranged planar to the loader wheel and in coordinated juxtaposed movement therewith for receiving the chips from the cavities in the loader wheel to the outer marginal edge of the transfer wheel for subsequent movement therewith, a second inspection station, external the transfer wheel, for viewing other external surfaces of the chips during their movement on the transfer wheel, computer/processor for tracking the positions of the chips that have passed and failed inspection by the first and the second inspection station, first removal means for ejecting chips that have failed inspection from the outer marginal edge of the transfer wheel for capture at a location, and a second removal station for removing chips that have passed inspection from the outer marginal edge of the transfer wheel for capture at another location.

35 Claims, 15 Drawing Sheets

| Body Dimensions | | | | | |
|---|---|---|---|---|---|
| Style | Length L (mm) | Width W (mm) | Thickness T-Max (mm) | Termination Band Width BW (mm) | Termination Separation S-Min. (mm) |
| CC0402 | 1.0 ± 0.10 | 0.50 ± 0.10 | 0.6 | 0.25 ± 0.15 | 0.30 |
| CC0603 | 1.6 ± 0.15 | 0.80 ± 0.15 | 0.9 | 0.35 ± 0.15 | 0.70 |
| CC0805 | 2.0 ± 0.20 | 1.25 ± 0.20 | 1.3 | 0.50 ± 0.25 | 0.75 |
| CC1206 | 3.2 ± 0.20 | 1.60 ± 0.20 | 1.5 | 0.50 ± 0.25 | 0.75 |
| CC1210 | 3.2 ± 0.20 | 2.50 ± 0.20 | 1.7 | 0.50 ± 0.25 | 0.75 |
| CC1812 | 4.5 ± 0.30 | 3.20 ± 0.20 | 1.7 | 0.60 ± 0.35 | 0.75 |
| CC1825 | 4.5 ± 0.30 | 6.40 ± 0.40 | 1.7 | 0.60 ± 0.35 | 0.75 |
| | (in) | (in) | (in) | (in) | (in) |
| CC0402 | 0.040 ± 0.004 | 0.020 ± 0.004 | 0.024 | 0.010 ± 0.006 | 0.012 |
| CC0603 | 0.063 ± 0.006 | 0.032 ± 0.006 | 0.035 | 0.014 ± 0.006 | 0.028 |
| CC0805 | 0.079 ± 0.008 | 0.049 ± 0.008 | 0.051 | 0.020 ± 0.010 | 0.030 |
| CC1206 | 0.126 ± 0.008 | 0.063 ± 0.008 | 0.059 | 0.020 ± 0.010 | 0.030 |
| CC1210 | 0.126 ± 0.008 | 0.098 ± 0.008 | 0.067 | 0.020 ± 0.010 | 0.030 |
| CC1812 | 0.177 ± 0.012 | 0.126 ± 0.008 | 0.067 | 0.024 ± 0.014 | 0.030 |
| CC1825 | 0.177 ± 0.012 | 0.252 ± 0.016 | 0.067 | 0.024 ± 0.014 | 0.030 |

INSPECTION MACHINE FOR SURFACE MOUNT PASSIVE COMPONENT

RELATION TO OTHER PATENT APPLICATIONS

This is a continuation-in-part application of my previously filed U.S. patent application INSPECTION MACHINE FOR MLCC filed Jun 2, 1999 and given Ser. No. 09/324,273

BACKGROUND OF THE INVENTION

1. Field of the Invention

This invention pertains to the field of automatic handling equipment. More particularly, it pertains to a high speed machine for loading, visually inspecting, and classifying surface mount passive components (a type of miniature electronic component) using extreme care and particular accuracy.

2. Description of the Prior Art

As our society matures, the electronic industry continues to burst forth with new and more diversified products and services. More uses are being found for computers and computer components. As these uses expand, there is constant pressure to reduce the size of computers, their components and the circuitry involved. As an example, the age-old capacitor has shrunk from a cigarette-size cylinder with wires extending from the ends thereof to tiny ceramic devices called "MLCC" (Multi-Layer Chip Capacitors) and "SURFACE MOUNT PASSIVE COMPONENTS", smaller than a grain of rice with metal terminations at the ends thereof. At the present time, these "chips" as they are generically known, have been reduced in size to a ceramic device having overall dimensions of 0.040×0.020—0.020 inches. Fifty of them could be set side-by-side within an inch. These chips come in a range of sizes as shown in FIG. 1.

In addition to the pressure to make these components smaller, there is similar pressure to process them faster. In processing chips, numerous electronic tests must be conducted on each to classify them according to their electronic properties. Some of these tests are described in detail in U.S. Pat. No. 5,673,799 but can be summarized as a Dissipation Factor test, a Capacitance Test, a Flash Test, and an Insulation Resistance Test. New tests are constantly being established so that the battery of tests to be conducted on these miniature chips continues to grow.

In order to make processing chips more efficiently, it is necessary to eliminate visibly flawed chips from the electronic testing phase so that overall processing time is reduced and electronic testing is conducted only on those chips that can fulfill all the requirements of the circuitry. Examples of such visually observable flaws are delamination of the dielectric body, cracks in the chip's exterior, divots from the corners or along a marginal edge, or flaws in the metal termination such as smears, spillovers, and unacceptable waviness in the termination paste. These flaws are known to cause changes in the desired electric characteristics of the chip such that they may be segregated for use in less demanding environments.

Accordingly, a movement is underway to subject pretested chips to visual checks so that damaged chips can be segregated for use in other areas of the industry, where such flaws can be tolerated, thus making the subsequent electrical testing more efficient and thereby increase handling rates and reduce the costs of producing an acceptable high quality chip. To perform the visual test in an efficient manner, it is necessary to process them at high throughput rates and yet be gentle in handling them. Rates approaching 75,000 per hour are being sought. This means that one machine must visually inspect twenty to twenty-one miniature ceramic chips each second. To do so requires a machine that can handle a huge amount of chips in an efficient manner. However, any overt force applied to the chips, such as crowding them in a confined area or dropping them a distance onto a flat surface will produce its own brand of flaws, usually in the form of cracks in the chip.

SUMMARY OF THE INVENTION

This invention is a visual inspection machine for miniature multilayer capacitor chips (chips) comprising a rotating loader wheel of finite thickness defined by an outer rim for accepting the 3-dimension miniature chips on the rim; a first inspection means, spaced-apart from the loader wheel; for visually inspecting the single outer surface of the chip during its travel on the wheel, a rotating transfer wheel defined by an outer marginal edge, arranged planar to the loader wheel and in coordinatedjuxtaposed movement therewith, for relocating the chips from the rim of the loader wheel to the outer marginal edge of the transfer wheel following passage beyond the first inspection means; a second inspection means, spaced-apart from the transfer wheel, including television caneras and possibly the use of mirrors, LEDs, strobe lights, prisms, and the like, for visually inspecting the other surfaces of the chip during its travel on the transfer wheel, a computer for locating and following each chip from its initial location on the loader wheel through its passage on the transfer wheel to identify it as a visually inspected and "passed" or "failed" chip, as well as classifying the "failed" chips as to their specific failure, i.e., delamination, chipped, smeared termination, etc.; a first pneumatic means for removing rejected "failed" chips (either as a whole group or by specific failure) from the outer marginal edge of the transfer wheel, for capture in one or more bins; and, a second pneumatic means for removing visually accepted chips from the outermarginal edge of the transfer wheel for capture in one or more other bins.

Other features of the invention include the ability to handle and visually inspect one of the smallest chips, known in the industry as an "0402" chip, having external dimensions as small as 0.040×0.020×0.020 inches, the ability to handle throughputs as high as 100% of maximum loading capability of the machine, moving these small chips delicately so that handling by the machine does not result in damage to the chips, being able to visually check a part of or the full exterior of the chip by placing the chip in only two positions, delicately removing the chips from the machine into sorted bins, and very safely and efficiently insuring only visually acceptable chips reach the "good" bin. Still further, the bins are of a unique design whereby the bottoms thereof onto which the chips fall are angled to provide an inclined surface thus preventing any damage or further damage to the chips during their passage from the transfer wheel into the appropriate bin.

Accordingly, the main object of this invention is a machine which performs a fast and safe visual inspection of these miniature ceramic chips at high throughput rates using delicate handling technique, to insure the chips will not be degraded through handling. Other objects of this invention include a machine which may inspect up to all six sides of a chip, using only two positions of the chip during inspection; a machine that insures against surface damage of a chip during all phases of inspection and classification phases of the testing; a machine that provides foolproof classification and collection of chips that pass inspection into a single location; and, a machine that can handle upwards of 70,000 chips per hour in the visual inspection phase.

These and other objects of the invention may be determined by reading the description of the preferred embodiments along with the drawings attached hereto. The scope of protection sought by the inventor may be gleaned from a fair reading of the claims that conclude this specification.

DESCRIPTION OF THE PREFERRED EMBODIMENT

Figure 1:
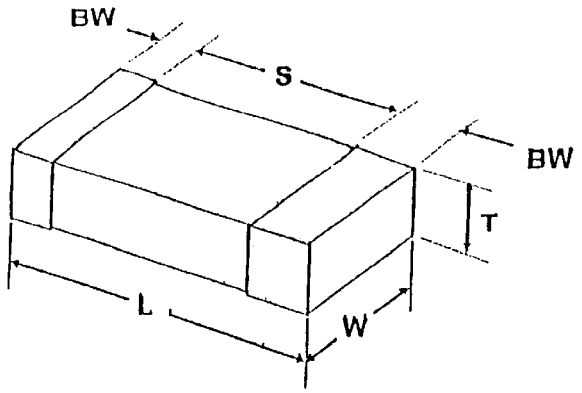
FIG. 1 is a specification sheet showing the range of body dimensions of chips from the largest (Style CC1825) to the smallest (Style CC0402) to the squarest (Style CC0603) to the flattest (Style CC1825)
Figure 2:
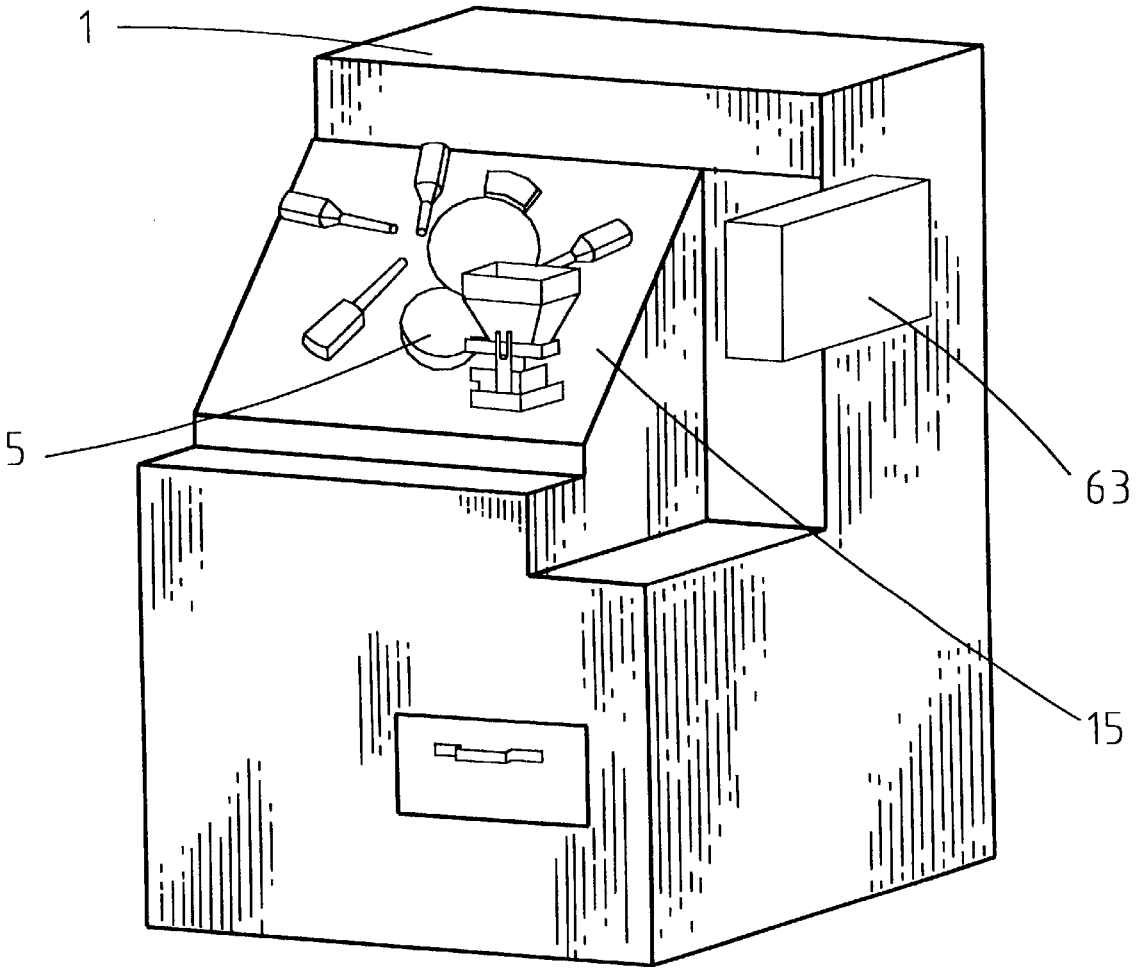
FIG. 2 is an illustrative view of the machine and components of this invention.
Figure 3:
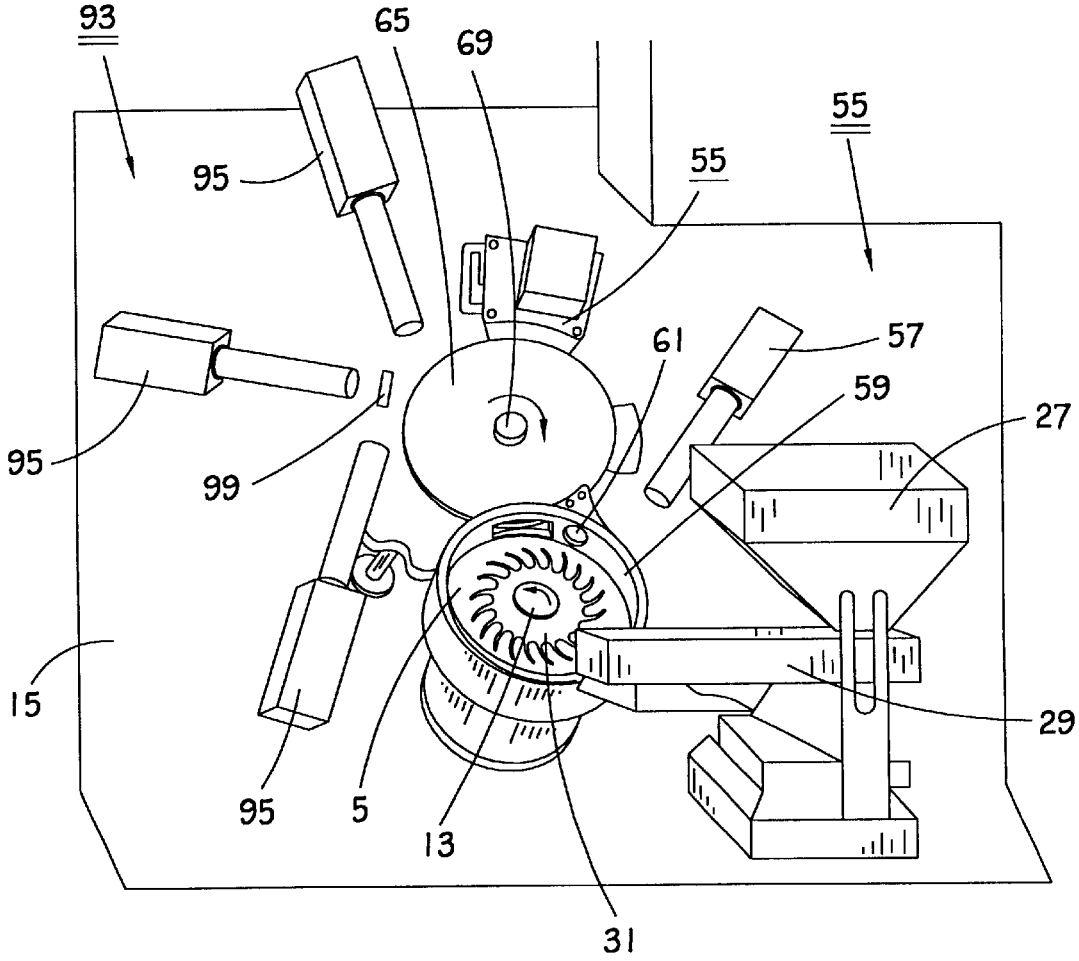
FIG. 3 is a close-up illustrative view of the location of the components of this invention that are shown in FIG. 2.
Figures 4, 5:
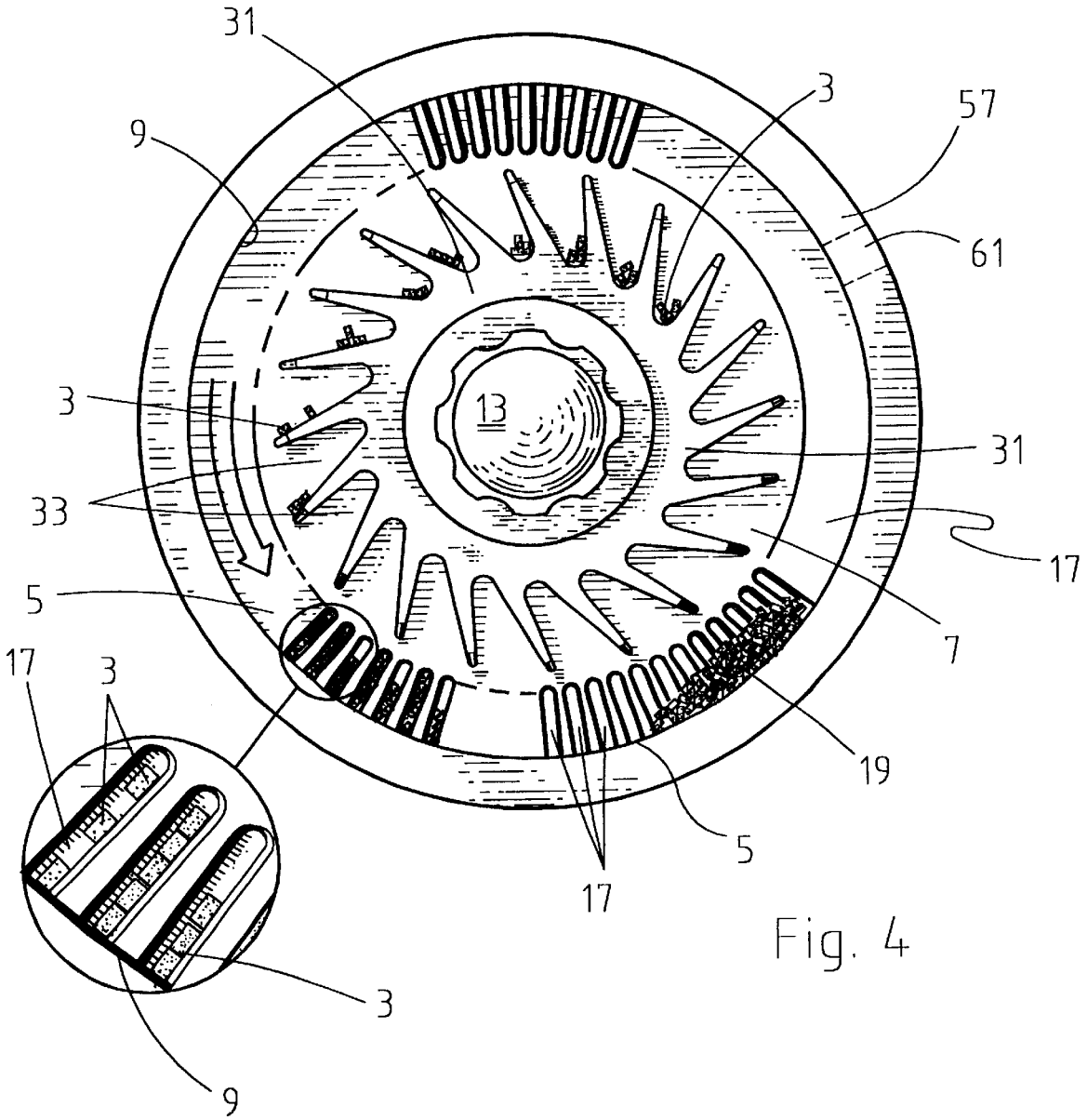
FIG. 4 is a top view of one embodiment of the loader wheel of this invention.
FIG. 5 is a close-up view of a portion of the loader wheel shown in FIG. 4.

Turning now to the drawings wherein elements are identified with numerals and like elements are identified with like numerals throughout the 21 figures, FIGS. 2, 3 and 4 show the overall arrangement of the physical elements of this invention of a machine 1 for handling miniature ceramic chips 3 to comprise a round, preferably circular, feed plate or loader wheel 5 defined by an upper surface 7 and terminated by an outer rim 9. Loader wheel 5 is mounted on a center shaft 13 for rotation thereabout, driven by a motor (not shown) on an inclined, preferably 45°, base surface 15 and arranged for accepting chips in fixed position about rim 9 for later visual inspection.

Figure 6:
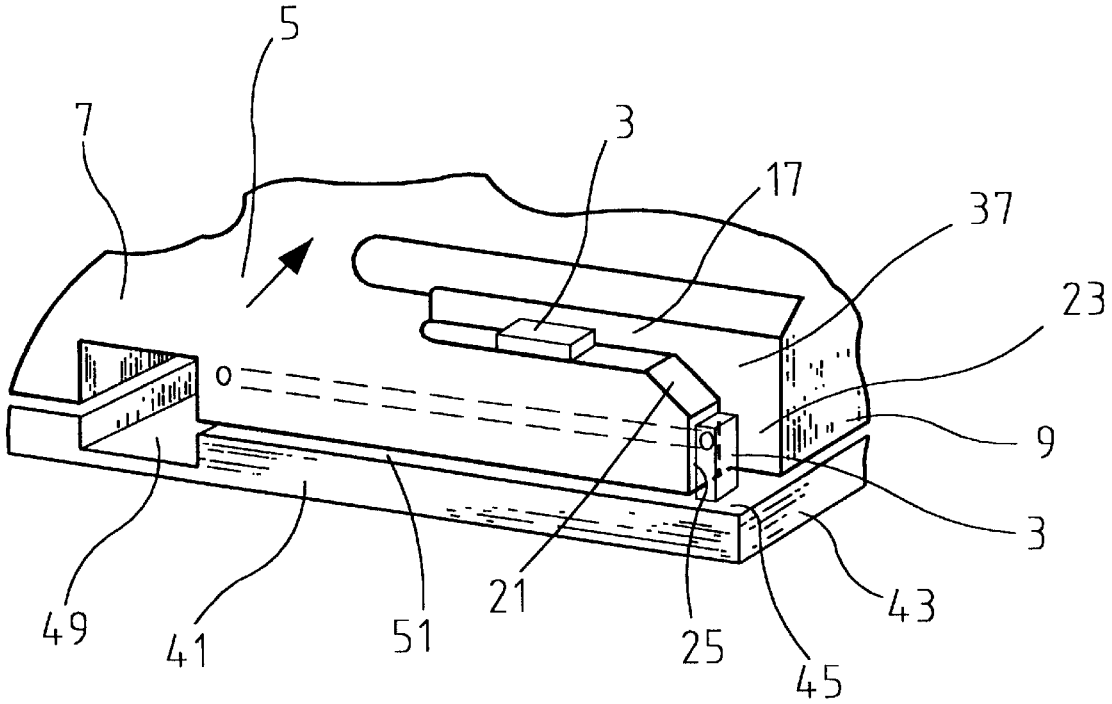
FIG. 6 is a close-up view of a portion of the top surface, groove, cavity and outer rim of one embodiment of the loader wheel of this invention showing a vacuum entry port on the rear cavity wall used to hold the chip in the cavity.

As shown in FIGS. 4, 5 and 6, a plurality of narrow grooves 17 are formed in loader wheel upper surface 7, directed radially outward toward rim 9, and arranged to pass through an inventory of chips 19 and receive therein at least one of the chips from said inventory in restricted orientation. By "restricted orientation" is meant that grooves 17 are made of a width that allows a chip to enter therein on one of its sides (either a side wall or a front wall or a rear wall) with the central axis (running through the top and bottom surfaces of the chip) lying radially outward but not transversely across the groove. As groove 17 approaches outer rim 9 each groove turns downward, about a chamfered or beveled corner 21, formed in the bottom of groove 17 in loader wheel 5, into a cavity 23 and forms cavity inner wall 25. Grooves 17 are generally employed when dealing with larger chips.

Inventory 19 of chips is passed from a hopper 27 along a vibrating chute 29 and gently deposited in the six to five o'clock position on upper surface 7 of loader wheel 5. A central ring 31, having a plurality of outwardly extending arms defining pockets 33, is located on top of loader wheel upper surface 7 and aids in gently moving the chips outward toward outer rim 9.

Figure 7:
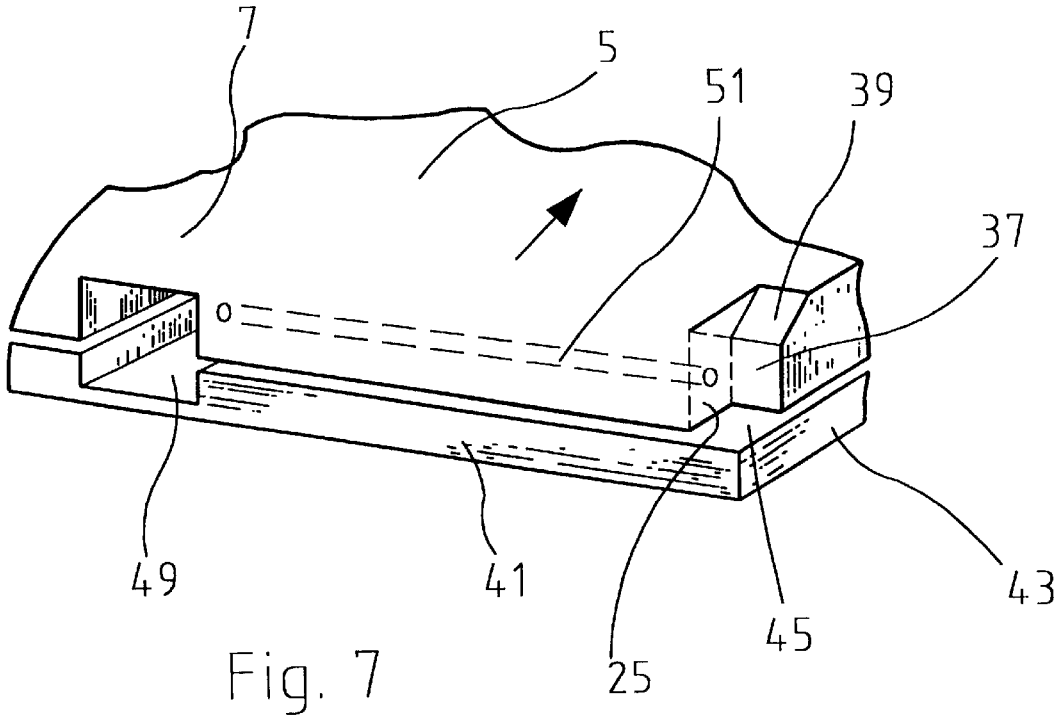
FIG. 7 is a similar close-up view of another embodiment of the top surface, cavity and outer rim of the loader wheel of this invention showing a vacuum entry port on the rear cavity wall used to hold the chip in the cavity.

For smaller chips, the grooves are dispensed with and cavity 23 is formed directly from loader wheel upper surface 7 as shown in FIG. 7. In this embodiment, cavity 23 is defined by spaced-apart cavity side walls 37, cavity inner wall 25 and accompanied by a corner 39 formed in cavity side wall 37 in the direction of rotation of loader wheel 5, as shown in FIG. 7. In one preferred embodiment of this invention, corner 39 is beveled in the form of a chamfer, as shown in FIG. 7. Cavity 23 has no wall facing outward from outer rim 9, thus forming an opening, and thus exposing a side or front or rear surface of a chip 3 outward from outer rim 9 when residing in cavity 23 as shown in phantom in FIG.

A first vacuum means comprising a first stationary vacuum plate 41, shown in FIGS. 6 and 7, is positioned beneath loader wheel 5, and separated a short distance therefrom, such as 0.002 inch, and extends outward, underneath loader wheel 5 and terminates at a peripheral edge 43 under the outermost end of outer rim 9 thus forming a floor 45 for each cavity 23 on which a chip 3 can reside. As shown in the same figures, a first vacuum chamber 49 is formed in the upper part of first stationary vacuum plate 41 and the lower part of loader wheel 5, inward from cavities 23 that is connected to a vacuum source (not shown). A small diameter passageway 51 is formed in loader wheel 5, beginning in cavity inner wall 25 and passing through the interior of loader wheel 5 to connect with vacuum chamber 49 as shown in FIGS. 6 and 7. Passageway 51 delivers vacuum to cavity 23 that holds chip 3 therein. The slight separation between the top of stationary vacuum plate 41 and the bottom surface of loader wheel 5 provides another vacuum path that also adds to the retention power for holding chip 3 in cavity 23 as shown in FIG. 6.

A first inspection means 55, such as a television camera 57 or charged-couple device, shown in FIG. 3 in spaced-apart relationship from loader wheel 5, and is provided for viewing and inspecting the outer exposed surface of chip 3 as the chip moves by means 55 temporarily located in cavity 23. A wall 59 is provided closely adjacent loader wheel outer rim 9, from about the six o'clock position to about the 2:30 o'clock position, to aid in retaining chips 3 against outer rim 9 and in cavities 23. An opening or window 61 is formed in wall 59 at about the 2:00 o'clock position for first inspection means 55 to view the exposed surface of chip 3 as it passes by in its rotation in cavity 23 on outer rim 9. A computer/computer processor 63 (see FIG. 2) is provided on machine 1 and interconnected first inspection means 55 to begin to follow each chip 3 as it progresses throughout the visual inspection process.

Figure 8:
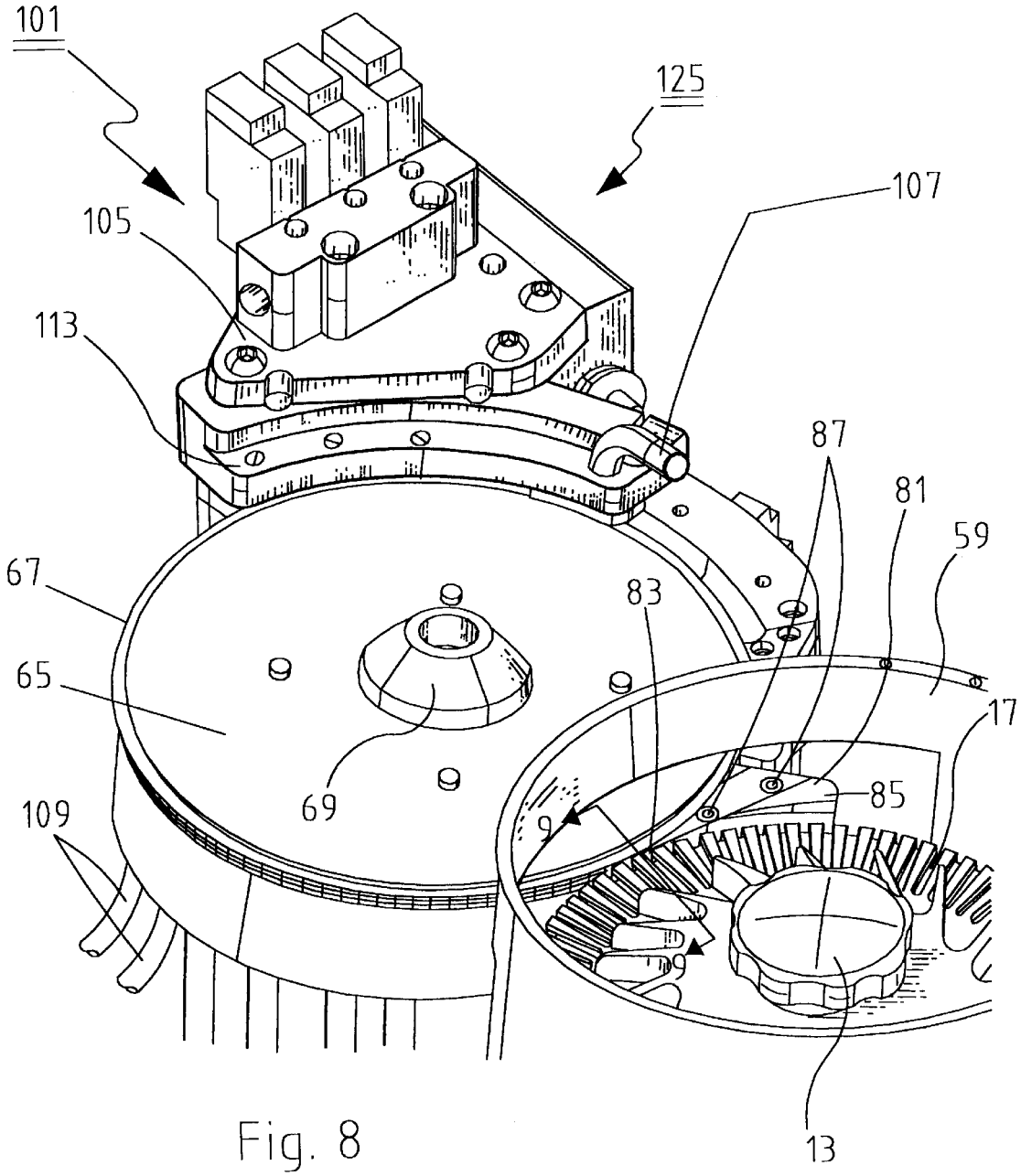
FIG. 8 is a perspective view of the perigee area (transfer area) between the loader wheel and the transfer wheel and the capture manifold for removing chips from the transfer wheel.
Figure 9:
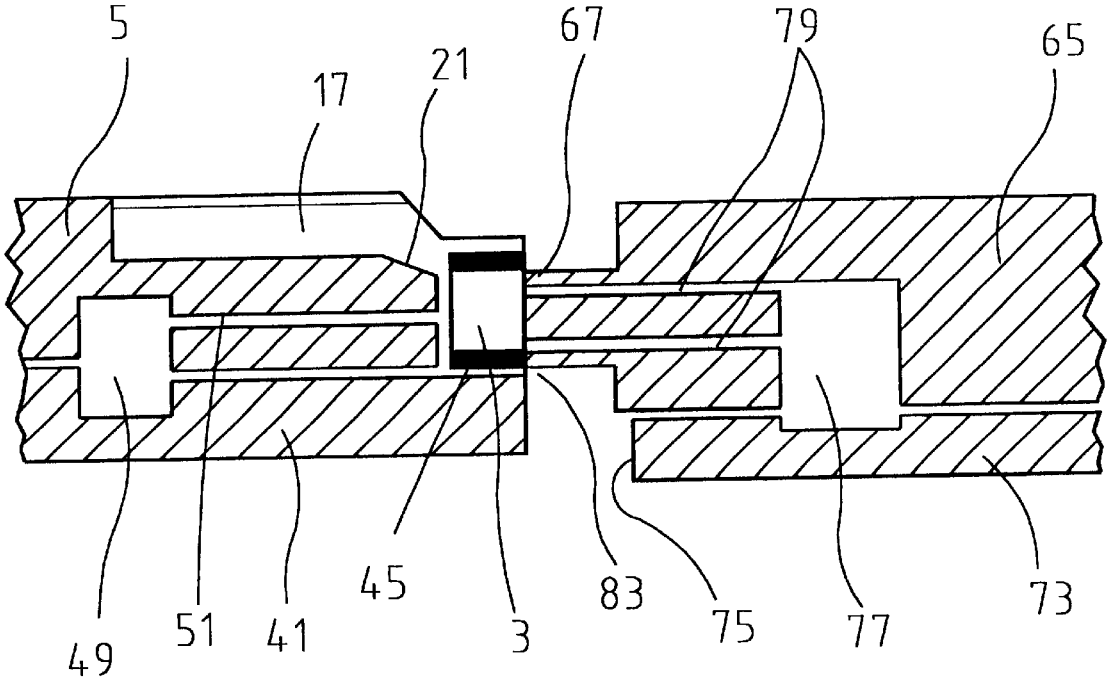
FIG. 9 is a cross-sectional view of the transfer area between the loader wheel and the transfer wheel, taken along lines 9—9 in FIG. 8, showing how a chip is transferred therebetween.

Also as shown in FIGS. 3, 8, and 9, a round, preferably circular, transfer plate or wheel 65, terminated by an outer marginal edge 67, is mounted on a center shaft 69 for rotation thereabout. Transfer wheel 65 is driven by a motor (not shown) on the same inclined surface as loader wheel 5, arranged planar (i.e., lying in the same plane) to loader wheel 5 and in coordinated juxtaposed movement therewith, for relocating chips 3 from cavities 23 in outer rim 9 of loader wheel 5 to said outer marginal edge 67. By "coordinated juxtaposed movement" is meant that both loader wheel 5 and transfer wheel 65 come into almost tangential contact and at the same perimeter speed so that chips 3 may be delicately transferred from cavities 23 in outer rim 9 directly and radially outward to outer marginal edge 67 thus providing careful handling of the chips. In addition, as shown in FIG. 9, outer marginal edge 67 of transfer wheel 65 is purposely made thinner than the vertical height of the chip under inspection so that the top and bottom surfaces, left and right side surfaces, and the front surface of the chip are exposed. This arrangement provides for simultaneous inspection of the top, bottom, left side, right side and front surfaces of the chip by cameras or viewing devices and mirrors and lights 71, as shown in FIG. 3, to focus the view of these five surfaces in fewer than five directions and inspection by less than five cameras.

A second vacuum means comprising a stationary vacuum plate 73, shown in FIG. 9, is positioned beneath transfer wheel 65 and separated a short distance therefrom, such as 0.002 inch, and extends outward, underneath transfer wheel 65 to terminate at an outer perimeter 75, short of outer marginal edge 67. As shown in the same figure, a second vacuum chamber 77 is formed in the upper part of second stationary vacuum plate 73 and the lower part of transfer wheel 65, inward from outer marginal edge 67 and outer perimeter 75, and is connected to a vacuum source (not shown). A pair of mutually spaced-apart small diameter passageways 79 are formed in transfer wheel 65 beginning at outer marginal edge 67 and pass through the interior of transfer wheel 65 to connect with second vacuum chamber 77 as shown in FIG. 9. In this embodiment, one passageway 79 may be substituted for the two shown in FIG. 9. Passageways 79 and the space between the bottom of transfer wheel 65 and the top of second stationary vacuum plate 73 deliver vacuum power to outer marginal edge 67 for holding chips 3 thereon. Chips 3 are held in cavities 23 in loader wheel 5 by a first vacuum and are transferred radially outward from cavities 23 to outer marginal edge 67 of transfer wheel 65 and thereafter held on outer marginal edge 67 by a second vacuum through pair of vacuum passageways 79 and through the space under transfer wheel 65 and above secondary vacuum plate 73. It has been found that by having the second vacuum pressure in second vacuum chamber 77 stronger, e.g. 3"Hg, than the first vacuum pressure, e.g., 1"Hg., in first vacuum chamber 49, a more positive transfer of chips 3 is effected and fewer chips drop away from either wheel during transfer.

Figure 10:
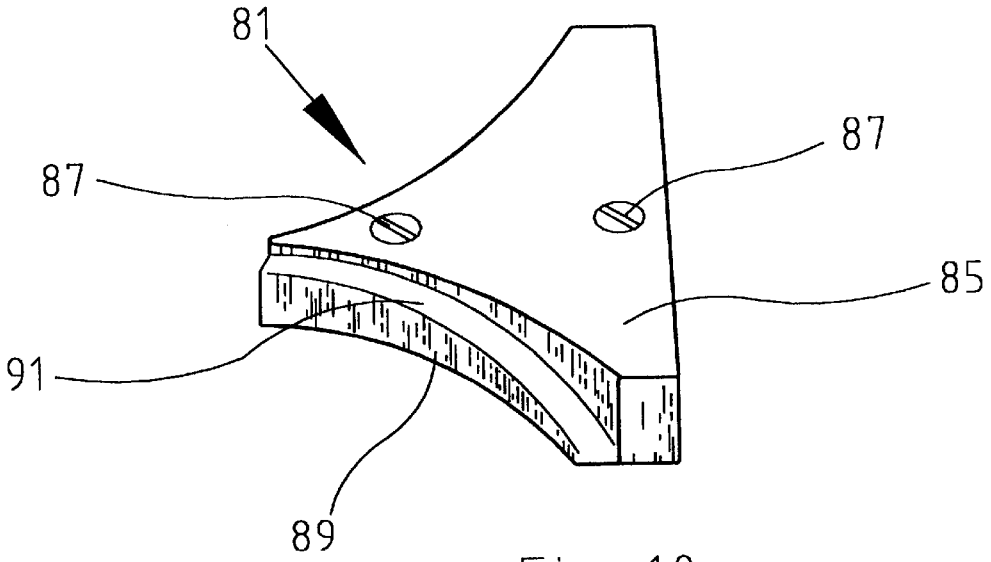
FIG. 10 is a close-up perspective view of the pre-transfer jam prevention assembly of this invention.

A pre-transfer jam prevention assembly 81 is provided and shown in FIGS. 8 and 10 for insuring chips 3 do notjam during transfer of chips 3 at the perigee 83 or closest point between loader wheel 5 and transfer wheel 65. Assembly 81 comprises a base 85 with lock-down screws 87, and has a first curved wall 89 formed thereon, preferably of the same radius of curvature as that of outer rim 9 of loader wheel 5, and arranged for placement closely adjacent thereto in front of perigee 83. A ramp 91 is formed in wall 89 and rises upward as wall 89 approaches perigee 83. Any chips 3 extending outward from cavity 23 (known as "doubling"), beyond outer rim 9, that would otherwise become jammed between the wheels during transfer of chip 3 from cavity 23 to outer marginal edge 67, are gently directed upward along ramp 91 and out of contact with loader wheel 5 and thus are removed from causing possible damage to machine 1.

A second inspection means 93, such as a single or plurality of television cameras 95 or charged-couple devices, is shown in FIG. 3 in spaced-apart relationship from transfer wheel 65 and at about the 9:00 o'clock position therewith for viewing and inspecting the outer surfaces of chips 3 as they rotate past the cameras temporarily held on outer marginal edge 67 of transfer wheel 65. This simultaneous viewing of all five surfaces is performed by using more than one viewing device and/or focusing a mirror 99 or other reflecting device on the top, bottom, front, and both left and right side surfaces of chips 3 as they are held by vacuum on their rear side or surface only on outer marginal edge 67. The rear sides or surfaces of chips 3 were already inspected by first inspection means 55 when chips 3 were held in cavities 23 on loader wheel 5. The mirror or mirrors may be located in various areas on machine 1 to enhance the reflection of a particular surface of a chip 3 for the particular camera or other viewing device.

Figure 11:
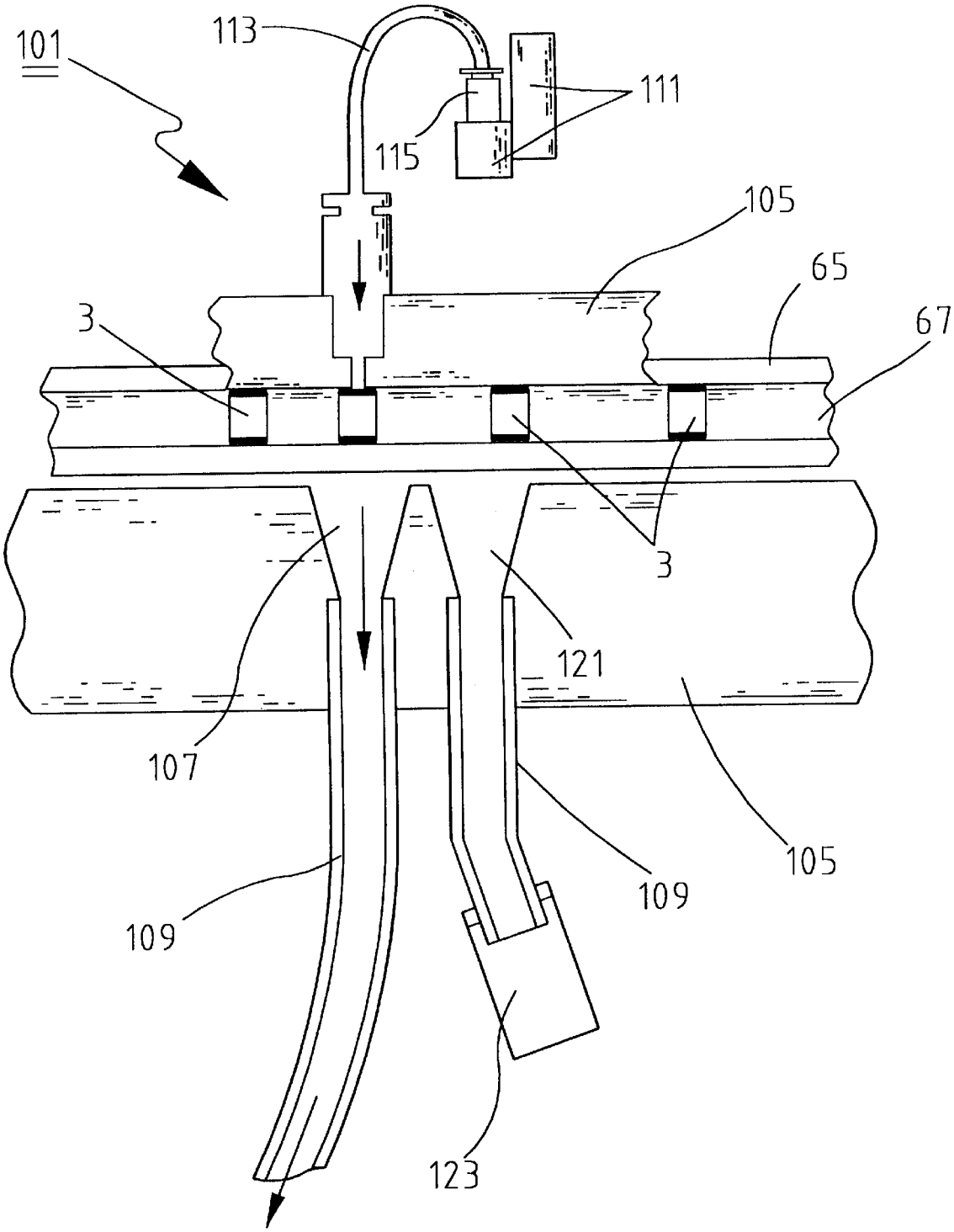
FIG. 11 is an illustrative view of the first removal means to recover chips that have failed the visual inspection.
Figure 12:
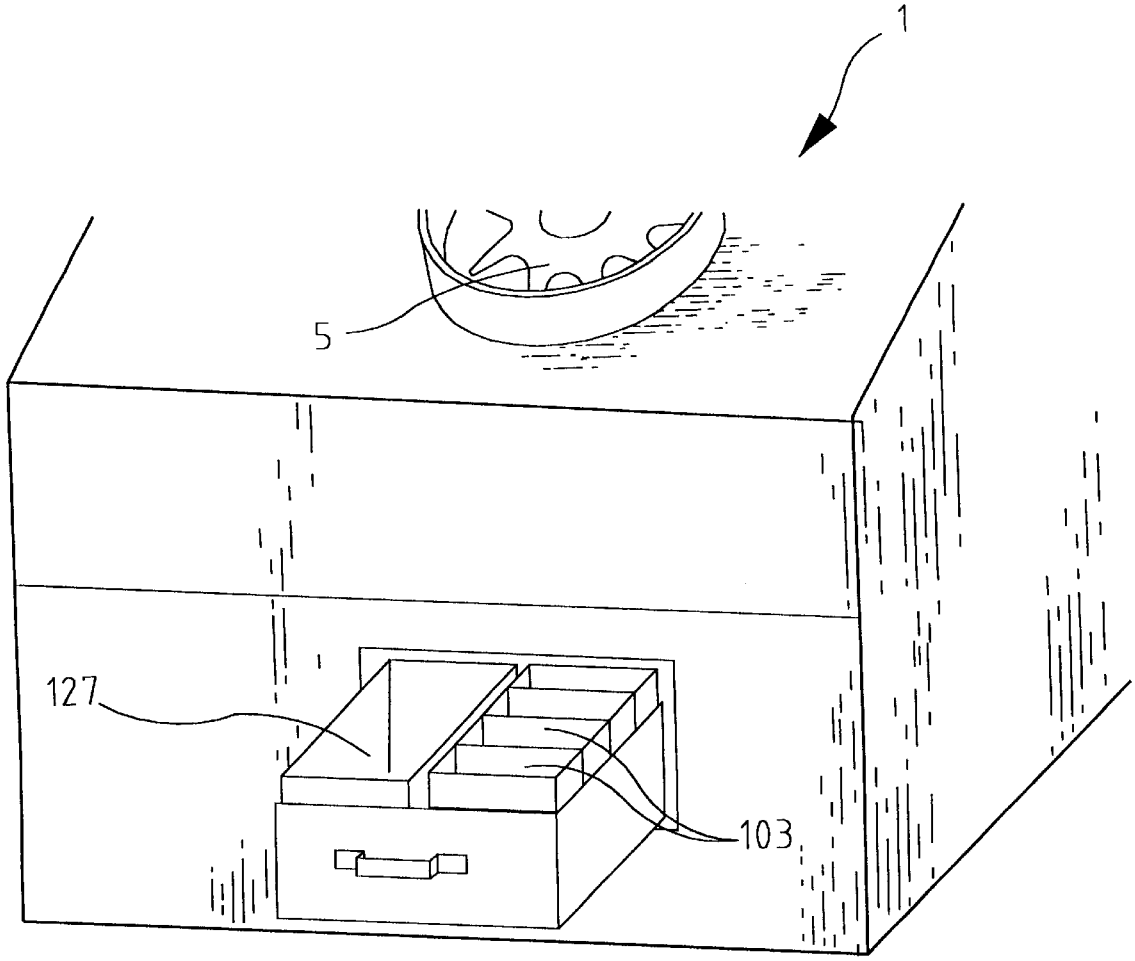
FIG. 12 is an illustrative view of the bins of this invention used in the recovery of rejected and passed chips.
Figure 15:
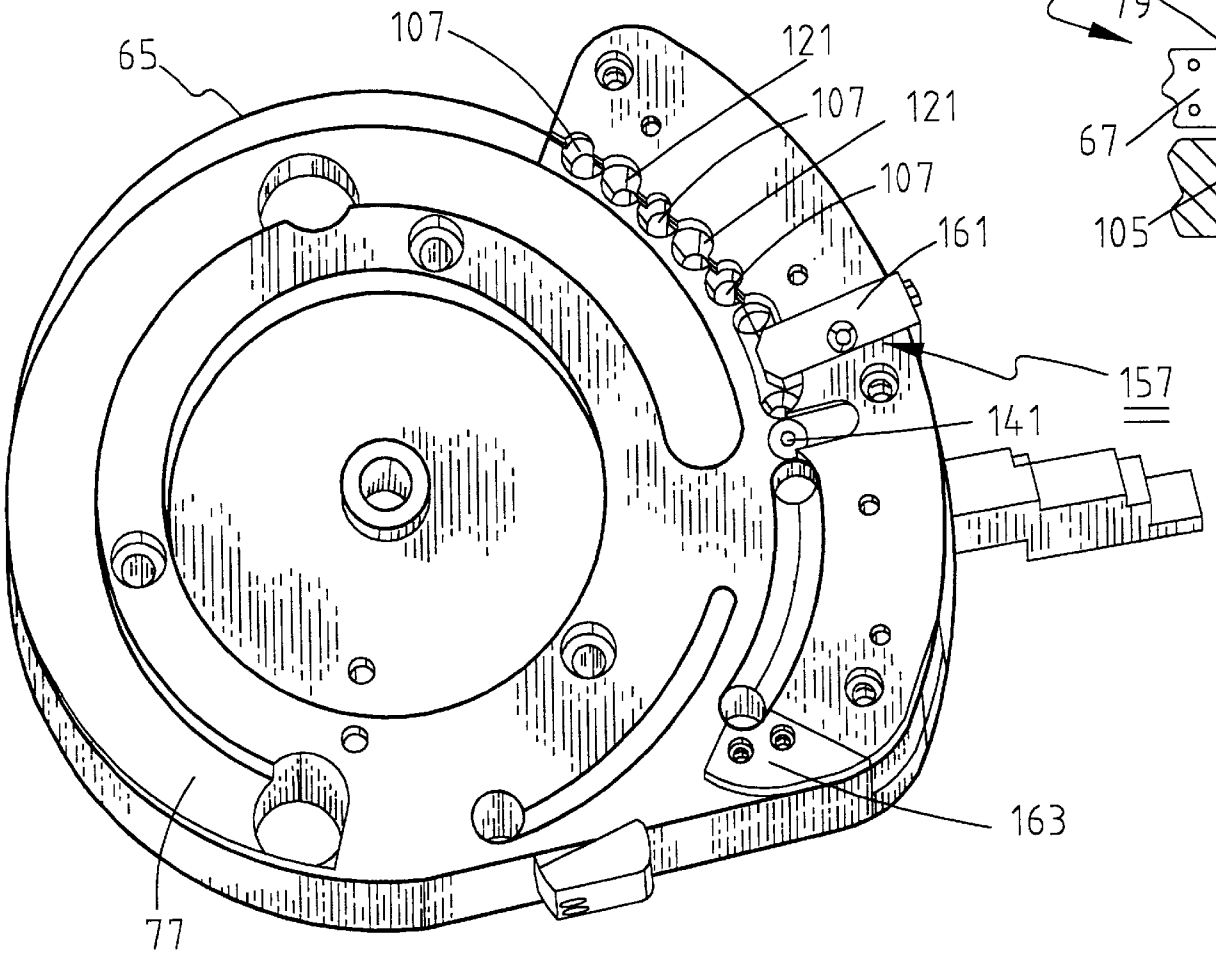
FIG. 15 is a perspective view of the lower part of the capture manifold and of the ports into which the chips are directed.

As shown in FIGS. 8 and 11 and partially in FIG. 15, a first removal means 101 is provided for ejecting rejected chips or chips from outer marginal edge 67 of transfer wheel 65 for capture in a first location such as in a capture bin 103 as shown in FIG. 12. First means 101 comprises a capture manifold 105 mounted adjacent and about (above and below) transfer wheel outer marginal edge 67 and includes a plurality of ejection openings or ports 107, located under marginal edge 67, that are preferably conical in nature leading downward to a flexible tube 109, such as a polyethylene tube, that in turn leads to capture bin 103. A first positive air pressure manifold 111 supplies pneumatic pressure to an air line 113 through an air valve 115 that terminates at an air nozzle 117, said valve 115 operatively controlled by computer/processor 63. When a chip 3 that has failed the visual test, is moved by transfer wheel 65 to a position over port 107, computer/processor 63 commands transfer wheel 65 to momentarily stop and opens air valve 115 to provide a short blast of downwardly directed positive pressurized air from air nozzle 117 on top of the chip forcing it downward, off its position on edge 67 of transfer wheel 65 and into port 107 where it drops by gravity and air pressure into capture bin 103. It is preferred that a safety port 121, of similar size and shape to port 107, be located on each side of port 107 and be connected by a flexible plastic tube 109 to a separate container 123.

Computer/processor 63 can be programmed to differentiate between chips that are rejected because of certain visually observable flaws and their specific position on transfer wheel 65 kept in a short term memory (not shown) in said computer/processor so that first air pressure manifold 111 can be operated to not only separate and recover failed chips from those chips that have passed the visual inspection test, but can determine failed chips that have different visual flaws and separate them via multiple ports 107 into different bins.

Figure 13:
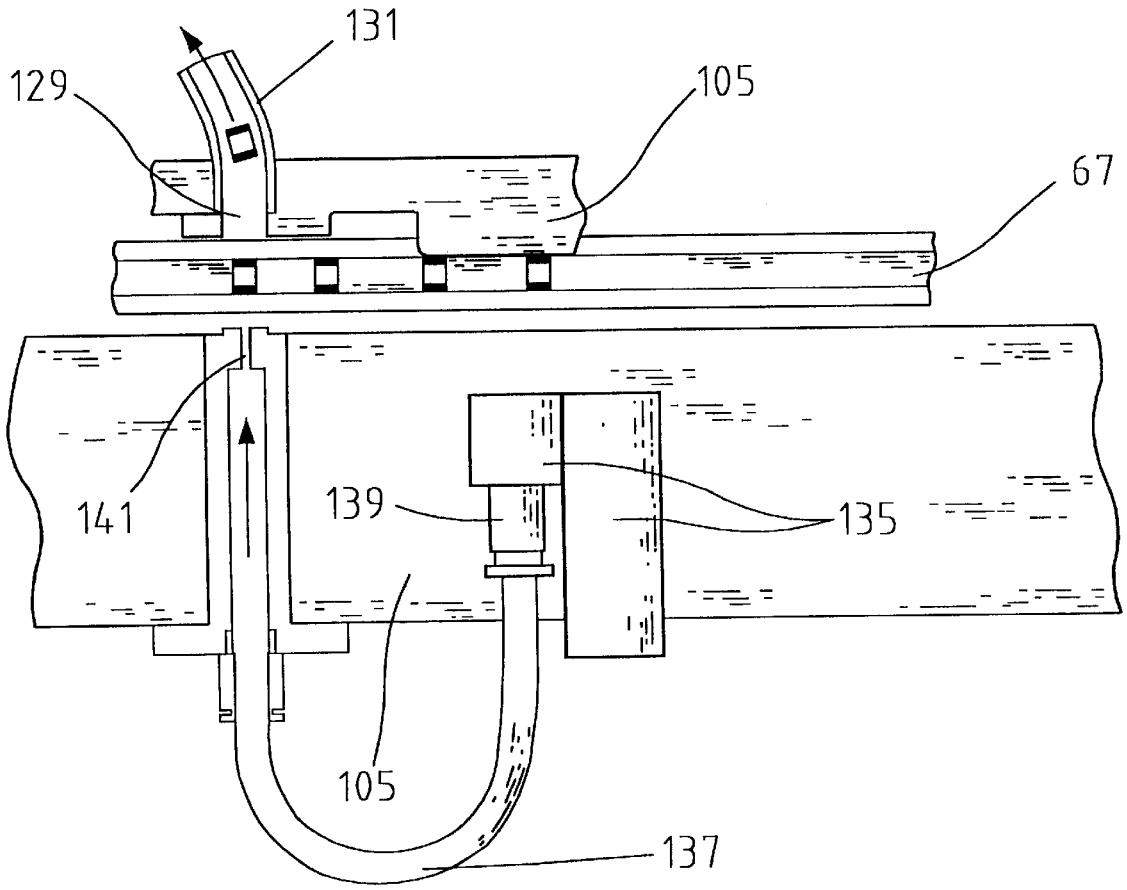
FIG. 13 is an illustrative view of the second removal means to recover chips that have passed the visual inspection.

As shown in FIGS. 8 and 13, a second removal means 125 is provided for ejecting chips, that have passed the visual test, from outer marginal edge 67 of transfer wheel 65 for capture in a second location such as in another bin 127 as shown in FIG. 12. Second means 125 comprises an ejection opening or port 129, located in capture manifold 105 above marginal edge 67, leading upward to a flexible tube 131, such as a polyethylene tube, that in turn leads to capture bin 127. A second positive air pressure manifold 135 supplies pneumatic pressure to an air line 137 through an air valve 139 that terminates at an air nozzle 141, said valve 139 operatively controlled by computer/processor 63. When a chip 3 that has passed the visual test is moved by transfer wheel 65 to a position under port 129, computer/processor 63 commands transfer wheel 65 to momentarily stop and opens air valve 139 to provide a short blast of upwardly directed positive pressurized air from air nozzle 141 on the bottom of the chip forcing it upward, off its position on edge 67 of transfer wheel 65 and into port 129 where it rises by pressurized air flow into capture bin 127.

Figure 14:
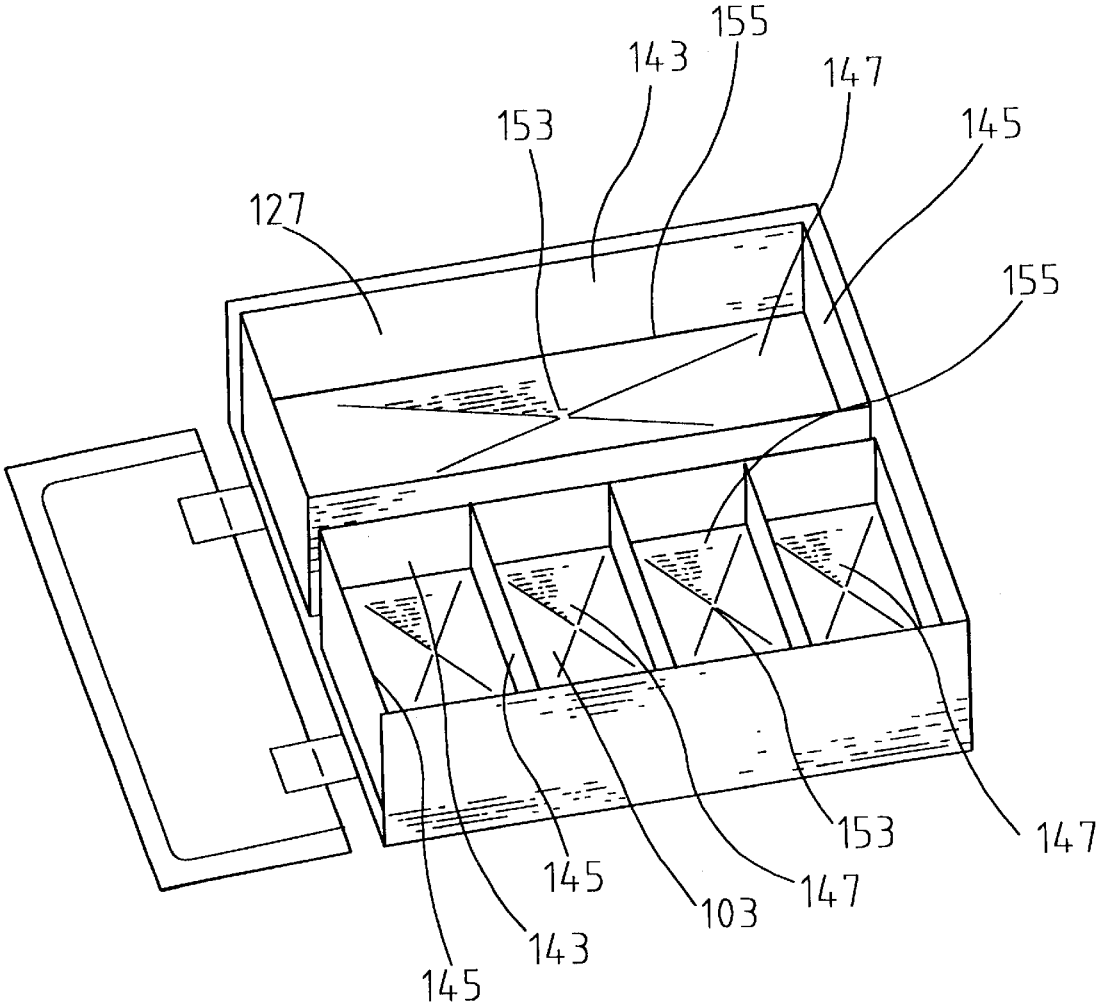
FIG. 14 is a perspective view of the bins and their respective sides and floors showing the changes in floor elevation that results in a gentler handling of the chips.

As shown in FIG. 14, bins 103 and 127 each are polygonal, such as rectangular shape, defined by a pair of oppositely disposed sidewalls 143, a pair of oppositely disposed end walls 145 and an interconnecting bottom wall or floor 147 integrally connected to provide the construction shown. The bins are of open top design. Bins 103 and 127 are unique in this invention in that their respective bottom walls or floors 147 are each raised in the geometric center 153 thereof and sloped downward toward the lower edges 155 of the respective walls. This geometry provides a sloping floor 147 in each bin and insures that each chip 3 does not fall onto a flat surface which is known in the industry to cause damage to the chips. By falling onto a slanted floor, the chips dissipate much of their kinetic energy gained in the fall from transfer wheel 65.

Figure 16:
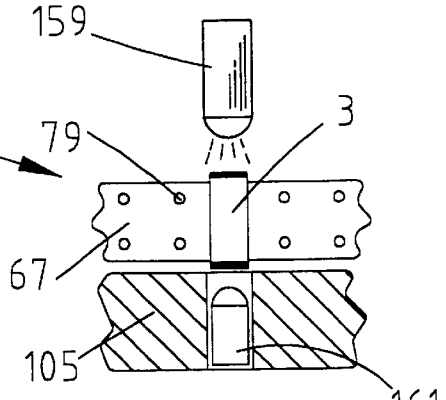
FIG. 16 is a close-up cross-sectional view of the position location means that certifies a chip is in a position on the transfer wheel.

To insure a chip that has passed the visual test is correctly followed, a position location means 157 is provided as shown in FIGS. 15 and 16. In the preferred embodiment, position location means 157 is shown in FIG. 16 to comprise a light source, such as an LED 159, directed downward (or upward) across outer marginal edge 67 and arranged to shine across edge 67 at locations where chips 3 are held thereto by vacuum power drawn through pairs of vacuum passageways 79. A light receiver 161 is located in capture manifold 105 on the opposite side of edge 67 and arranged to receive light from said light source 159. Computer/processor 63 is programmed to coordinate the position of all chips and track them throughout rotation of transfer wheel 65. When a chip turns up in a location that is not contemplated as a good chip that has passed the visual test, a warning is flashed and safety measures are instituted, such as stopping the rotation of loader wheel 5 and transfer wheel 65, so that the questionable chip can be removed.

In other embodiments of this invention, the questionable chip may be just allowed to continue past second removal means 125 and be caught by a scraper 163 (FIG. 15) that directs the chip to a separate bin.

Figure 17:
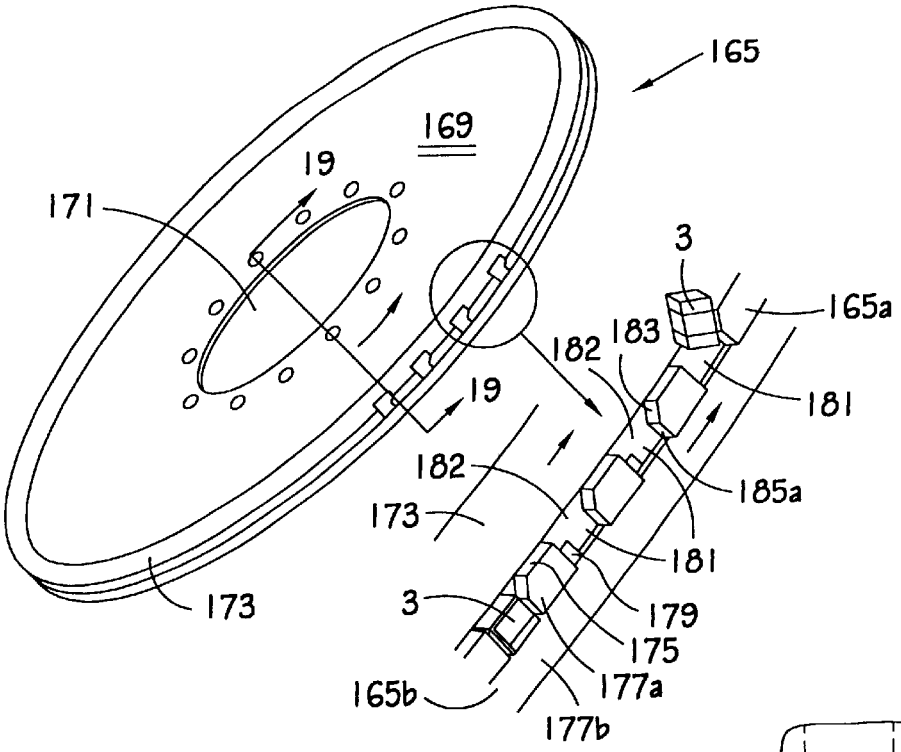
FIG. 17 is a perspective view of another embodiment of the feed plate or loader wheel of the invention with a broken-out view of a portion of the rim area of the loader wheel.

In another embodiment of this invention, and specifically when dealing with the smallest chips, such as the "0402" chip having dimensions of 0.040×0.020×0.020 inches, loader wheel 5 is modified, as shown in FIG. 17, to eliminate both central ring 31 and narrow grooves 17. Circular loader wheel 165 is the replacement and is shown in FIGS. 17–20 to be a strong, inflexible wheel defined as having a first flat top surface 169 extending outward from center shaft 171 by screws 172 or other fasteners, as shown, said flat top surface 169 bounded by a downwardly sloping top surface area 173 that blends into a second flat top surface 175 extending outward therefrom to a terminal circular rim 177. A plurality of cavities 181, of a size and shape to accept therein chips 3 in upright position, are formed in second flat top surface 175 atrim 177 and each cavity 181 opens outward onto rim 177 and is lead by a chamfered or beveled surface 183 on the side of cavity 181 in the direction of rotation of loader wheel 165 as shown by the arrows. Beveled surface 183 aids in introducing a chip, in proper orientation, into a cavity much as a shoehorn helps a person put on a pair of shoes. The chips are placed in an inventory 19, similar to that shown in FIG. 4, and new loader wheel 165 is set to rotate in the direction of the arrow on the same slant as previously described. Central ring 31 is not required in this embodiment. Cavities 181 are made very slightly wider than chips 3 so that, with the aid of chamfer 183, each chip can move from the surface of flat top surface 175 across chamfer 183 and into cavities 181 at filling rates approaching 100%.

Figure 18:
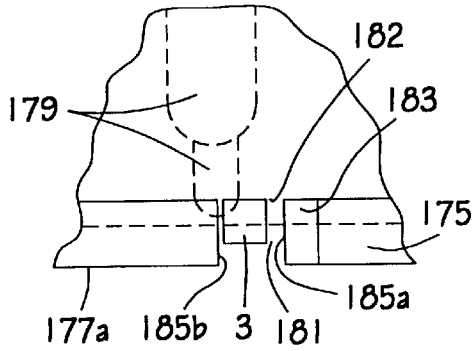
FIG. 18 is a close-up top view of one of the cavities formed in the embodiment shown in FIG. 17.
Figure 19:
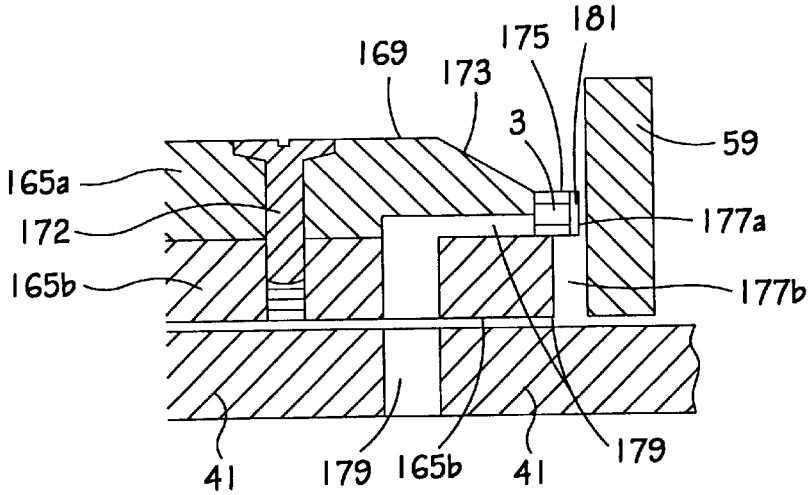
FIG. 19 is a sectional view of the embodiment of the loader wheel taken along lines 19—19 in FIG. 17.
Figure 20:
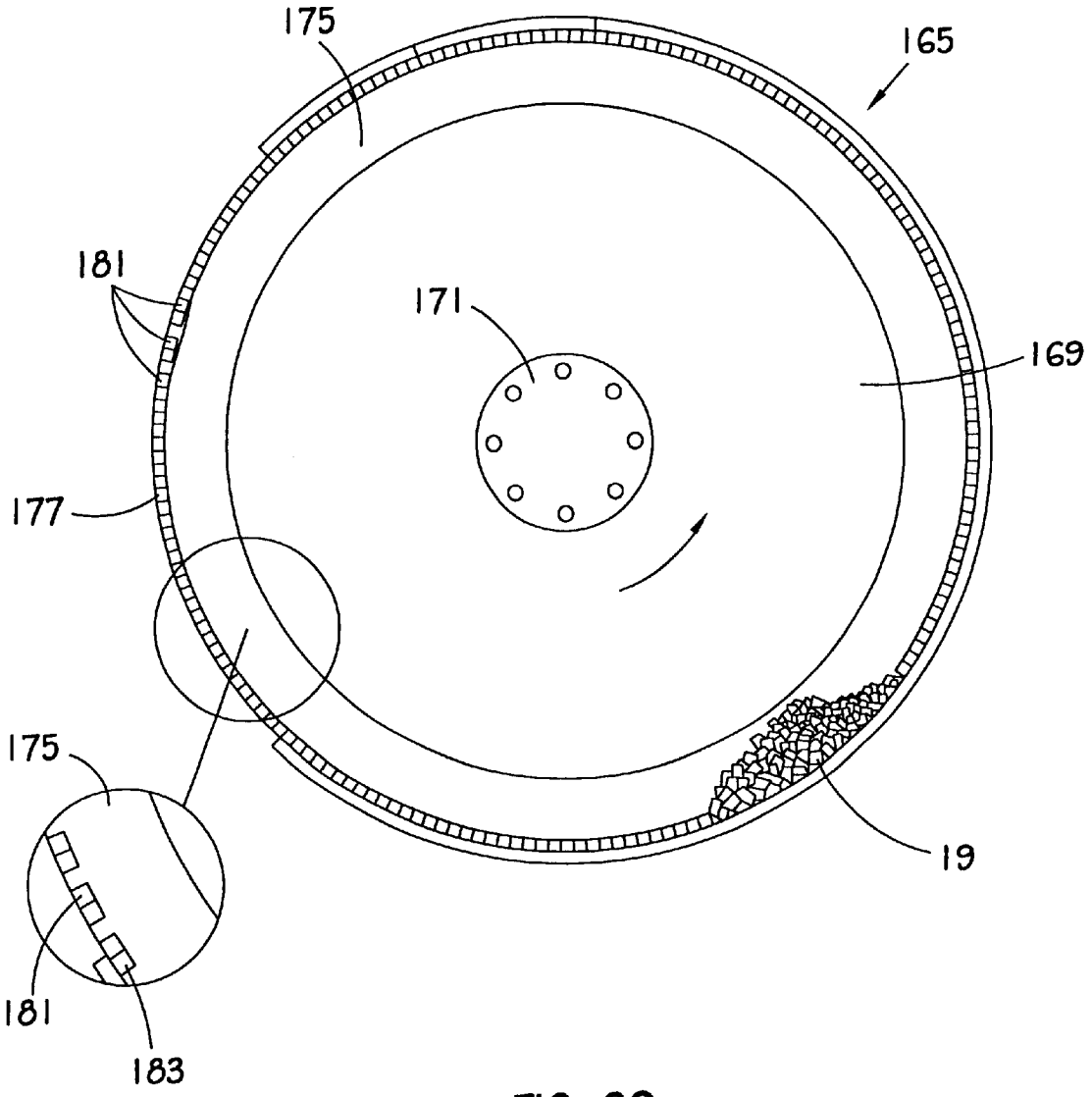
FIG. 20 is a top view of the embodiment of the loader wheel shown in FIG. 17 with a broken-out view of a portion of the rim area of the loader wheel; and, FIG. 21 is a sectional side view of the loader wheel and the stationary vacuum plate of the embodiment of the loader wheel shown in FIG. 17 showing a close-up of the cavity and the vacuum system used therewith.
Figure 21:
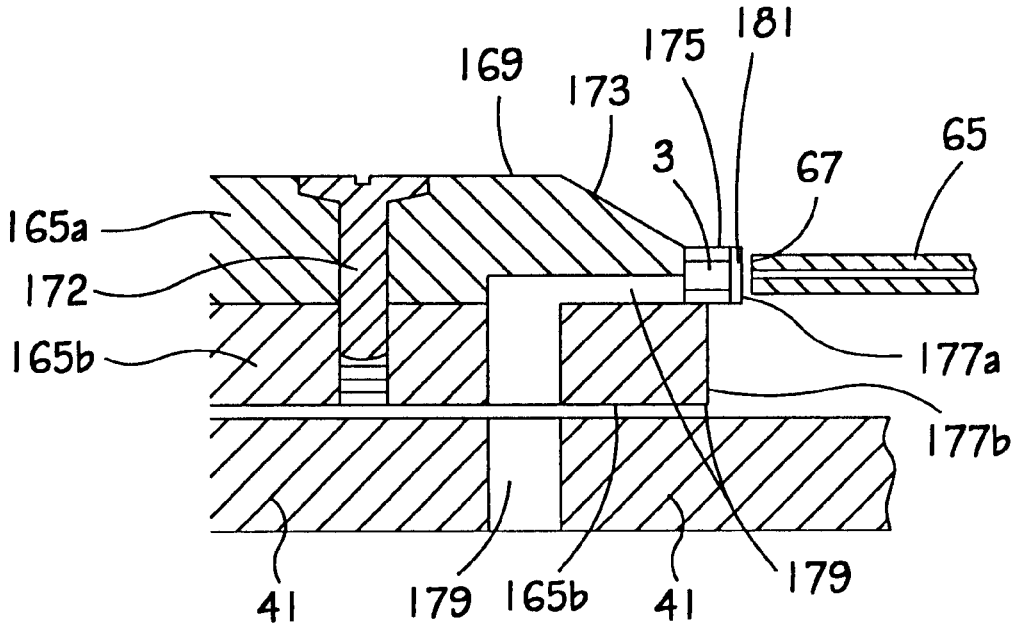

New loader wheel 165 is further unique in that it is actually made up of a laminate of two wheels **165*a* and 165*b*, each with its own rim 177*a* and 177*b* respectively, and each of different radius, as shown in FIGS. 17, 18, and 19. Loader wheel lower portion 165*b* has a smooth rim 177*b* that is set slightly inboard from loader wheel upper portion 165*a* and its rim 177*a*. Cavities 181 are formed only in upper wheel portion 165*a* opening outward into rim 177*a*. With this design, chip 3 in cavity 181 slightly overhangs rim 177*b*. In addition, stationary vacuum plate 41 and vacuum passageway 51 have been replaced by forming a vacuum passageway 179 upward from stationary vacuum plate 41 and through base loader wheel lower portion 165*b* into upper portion 165*a* and then outward into the corner of cavity 181 that is formed between the cavity rear wall 182 and cavity side walls 185*a* and 185*b* as shown in FIGS. 17 and 18, on the opposite side of cavity 181 from chamfer 183. In this configuration, shown in FIGS. 17, 18 and 19, first vacuum means is directed into the lower corner of said cavity side wall 185*b*, opposite chamfer 183, and the lower part of said cavity rear wall 182, in the corner formed between said cavity side wall 185*b* and said cavity rear wall 182. Cavity 181 opens outward onto rim 177*a* and is formed slightly wider than the width of chip 3 so that the chip easily falls down chamfer 183 from flat top surface 175 and is pulled by vacuum across cavity 181 by vacuum to reside in the opposite part of cavity 181 as shown in FIG. 17. This design has been found to be extremely efficient in filling all the cavities with chips in upright alignment in each cavity and at a high load rate. It has been also found to aid in later measuring the height of the chip through light illumination of the bottom and top exposed edges of the chip and comparing the images with standard measurements. Proper height measurement is one of the important specifications of the chip. Wheel 165***a* and 165*b* are fastened together with machine screws 172.

Further in this embodiment, more cameras may be used to view the various surfaces of the chip. In addition, transfer wheel 65 is often designed to have its outer marginal edge 67 made thicker than the vertical height of the chip because a thicker wheel is easier to produce, the chip is easily stabilized on thicker edge 67, and the thicker wheel works well when doing 1 to 4-sided chip inspections instead of the full 6-sided inspection.

While the invention has been described with reference to a particular embodiment thereof, those skilled in the art will be able to make various modifications to the described embodiment of the invention without departing from the true spirit and scope thereof. It is intended that all combinations of elements and steps which perform substantially the same function in substantially the same way to achieve substantially the same result are within the scope of this invention.

What is claimed is:

1. A visual inspection machine for six-sided, surface mount passive components comprising:

a) a rotating loader wheel defined by an outer rim for accepting there against at least one 3-dimension miniature capacitor chip for visual inspection;

b) a first inspection means, external said rotating loader wheel, for viewing at least a first side surface of the capacitor chip during its movement on said loader wheel;

c) a rotating transfer wheel defined by a smooth outer marginal edge, said wheel arranged planar to said loader wheel and in coordinated juxtaposed movement therewith, for relocating the capacitor chip from said outer rim of said loader wheel to said outer marginal edge of said transfer wheel;

d) a second inspection means, external said transfer wheel, for viewing the other external side surfaces and, optionally, the top and bottom surfaces of the capacitor chip during its movement on said transfer wheel;

e) computer/processor means for tracking the positions of capacitor chips that have passed and failed inspection by said first and said second inspection means;

f) removal means for ejecting chips that have failed inspection from said outer marginal edge of said transfer wheel for capture in a location; and, g) removal means for removing chips that have passed inspection from said outer marginal edge of said transfer wheel for capture in a different location.

2. The visual inspection machine of claim 1 wherein said loader wheel is inclined to the horizontal and includes:

a) an upper exposed wheel surface against which an inventory of chips is placed for loading;

b) at least one cavity including a corner leading thereinto formed in said upper wheel surface and at said outer rim, said cavity defined by a pair of spaced-apart side walls into which a chip is moved during loading; and, c) first vacuum means connected to said loader wheel for providing vacuum power for retaining the chip in said cavity for inspection.

3. The visual inspection machine of claim 1 further including:

a) an upper exposed wheel surface against which an inventory of chips is placed for loading;

b) at least one narrow groove formed in said upper exposed wheel surface directed outwardly toward said outer rim and including a corner formed therein, c) at least one cavity formed in said groove at the outer end thereof, said groove defined by a pair of spaced-apart side walls into which a chip is moved during loading;

d) said groove arranged to pass through said inventory of chips and receive therein at least one chip from said inventory in restricted orientation for movement into said cavity; and, e) said cavity having an opening formed therethrough for transferring the chip radially outward from said cavity and said outer rim, following inspection by said first inspection means.

4. The visual inspection machine of claim 2 wherein said corner is beveled to form a chamfer.

5. The visual inspection machine of claim 3 wherein said corner is beveled to form a chamfer.

6. The visual inspection machine of claim 2 further including a first stationary vacuum plate below and adjacent said loader wheel extending outward to terminate at a peripheral edge below said outer rim and forming a floor for each said cavity on which a chip can reside.

7. The visual inspection machine of claim 3 further including a first stationary vacuum plate below and adjacent said loader wheel extending outward to terminate at a peripheral edge below said outer rim and forming a floor for each said cavity on which a chip can reside.

8. The visual inspection machine of claim 1 further including a second stationary vacuum plate below and adjacent said transfer wheel extending outward to terminate at an outer perimeter below and short of said outer marginal edge to provide vacuum power to hold the chip onto said outer marginal edge of said transfer wheel.

9. The visual inspection machine of claim 2 further including:

a) a second stationary vacuum plate below and adjacent said transfer wheel extending outward to terminate at an outer perimeter below and short of said outer marginal edge; and, b) second vacuum means connected to said transfer wheel for providing vacuum power for retaining the chip on said outer marginal edge.

10. The visual inspection machine of claim 3 further including:

a) a second stationary vacuum plate below and adjacent said transfer wheel extending outward to terminate at an outer perimeter below and short of said outer marginal edge; and, b) second vacuum means connected to said transfer wheel for providing vacuum power for retaining the chip on said outer marginal edge.

11. The visual inspection machine of claim 6 further including at least one vacuum passageway in said loader wheel terminating in said cavity for holding the chip therein.

12. The visual inspection machine of claim 7 further including at least one vacuum passageway in said loader wheel terminating in said cavity for holding the chip therein.

13. The visual inspection machine of claim 6 further including at least two spaced-apart vacuum passageways in said transfer wheel terminating at said outer marginal edge for holding the chip thereon.

14. The visual inspection machine of claim 7 further including at least two spaced-apart vacuum passageways in said transfer wheel terminating at said outer marginal edge for holding the chip thereon.

15. The visual inspection machine of claim 1 wherein outer marginal edge of said transfer wheel is thinner than the vertical height of the chip to allow the chip to be held against said edge below its top surface and above its bottom surface thereby exposing both side surfaces, the top and bottom surface and the front surface to simultaneous visual inspection by said second inspection means.

16. The visual inspection machine of claim 1 further including:

a) a wall adjacent said loader wheel outer rim, to aid in retaining the chip against said outer rim and in said cavities; and, b) a window formed in said wall for said first inspection means to view the outermost surface of the chip as it passes by in its rotation on said outer rim.

17. The visual inspection machine of claim 1 wherein said first inspection means, external said loading wheel, for viewing the first side surface of the chip during its travel on said loading wheel is a charged-couple device camera.

18. The visual inspection machine of claim 1 wherein said second inspection means, external said transfer wheel, for viewing the second through sixth surfaces of the chip during its travel on said transfer wheel is a charged-couple device camera.

19. The visual inspection machine of claim 1 wherein said second inspection means includes a mirror for focusing one surface of the chip along the same path as another surface of the chip is sighted to concentrate the five surfaces of the chip into views that can be viewed by less than five viewing devices.

20. The visual inspection machine of claim 1 further including a pre-transfer jam prevention assembly comprising:

a) a guide located upstream and adjacent the perigee between said loader wheel and said transfer wheel;

b) a curved wall formed in said guide, having a radius of curvature equal to the radius of curvature of said loader wheel, and located in close proximity thereto; and, c) a ramp formed in said curved wall upward in the direction of rotation of said loader wheel and arranged to contact any chip extending outward from said cavity to force said extended chip upward, along said ramp, and away from said outer rim of said loader wheel.

21. The visual inspection machine of claim 1 wherein said first removal means for removing rejected chips from said outer marginal edge of said transfer wheel for capture in a single location comprises:

a) a manifold mounted adjacent, above and below a portion of said transfer wheel outer marginal edge;

b) at least one port located in said manifold and under said marginal edge of said transfer wheel for entry of failed or rejected chips; and, c) a first pressurized pneumatic manifold arranged for sending a stream of pressurized air through a control valve to at least one air nozzle set opposite said port and above said outer rim of said loader wheel, and operatively connected to said computer so that said air valve will momentarily open upon the computer's determination that a chip that has failed the inspection is located over said port, to allow a short blast of compressed air to blow down from said air nozzle onto the chip to dislodge it from its position on said outer marginal edge and blow it down into said port for conveyance to a collection bin.

22. The visual inspection machine of claim 21 further including at least one tube leading from said port into said collection bin to convey the chip therein.

23. The visual inspection machine of claim 1 wherein said second removal means for removing chips that have passed the visual inspection from said outer marginal edge of said transfer wheel for capture in a single location comprises:

a) a manifold mounted adjacent, above and below a portion of said transfer wheel outer marginal edge;

b) at least one port located in said manifold and above said marginal edge of said transfer wheel for entry of passed chips; and, c) a second pressurized pneumatic manifold arranged for sending a stream of pressurized air through a control valve to at least one air nozzle set opposite said port and below said outer rim of said loader wheel, and operatively connected to said computer so that said air valve will momentarily open upon the computer's determination that a chip that has passed the inspection is located below said port, to allow a short blast of compressed air to blow up from said air nozzle to the chip to dislodge it from its position on said outer marginal edge and blow it up into said port for conveyance to a collection bin.

24. The visual inspection machine of claim 23 further including at least one tube leading from said port into said collection bin to convey the chip thereto.

25. The visual inspection machine of claim 23 wherein said bin for collecting surface mount passive components from a visual inspection machine includes a slanted bin floor to provide an angled vector of direction for diffusing the kinetic energy of the chip as it is transferred to said transfer wheel.

26. The bin for collecting chips therein of claim 25 wherein said bin comprises enclosed side walls and a floor covering the area encompassed by said side walls and attached along the bottom of said walls wherein said floor is raised at the center of said bin to a level above the level of said floor at said walls to provide an angled vector of direction for diffusing the kinetic energy of the chip as it falls from said transfer wheel.

27. A visual inspection machine for six-sided, surface mount passive components comprising:

a) a rotating loader wheel defined by an outer rim for accepting there against at least one 3-dimension miniature capacitor chip for visual inspection;

b) a first inspection means, external said rotating loader wheel, for viewing at least a first side surface of the capacitor chip during its movement on said loader wheel;

c) a rotating transfer wheel defined by a smooth outer marginal edge, said wheel arranged adjacent to said loader wheel and in coordinated juxtaposed movement therewith, for relocating the capacitor chip from said outer rim of said loader wheel to said outer marginal edge of said transfer wheel;

d) a second inspection means, external said transfer wheel, for viewing the other external side surfaces and, optionally, the top and bottom surfaces of the capacitor chip during its movement on said transfer wheel;

e) computer/processor means for tracking the positions of capacitor chips that have passed and failed inspection by said first and said second inspection means;

f) removal means for ejecting chips that have failed inspection from said outer marginal edge of said transfer wheel for capture in a location; and, g) removal means for removing chips that have passed inspection from said outer marginal edge of said transfer wheel for capture in a different location.

28. A visual inspection machine for a surface mount passive component chip comprising:

a) a rotating circular loader wheel including an upper exposed wheel surface onto which an inventory of individual chips is placed for loading and a rim about said loader wheel in which a plurality of cavities are formed, each said cavity of a size and shape to accept a single chip therein from said inventory in a desired orientation, and further defined by a pair of spaced-apart cavity side walls and a rear cavity wall, said cavity leading down thereinto from said loader wheel surface;

b) first vacuum means connected to said loader wheel for providing vacuum power in each said cavity for retaining each chip in said cavity for a first inspection;

c) a first inspection means, external said loader wheel, for viewing at least a first side surface of the chip during its location in said cavity on said loader wheel;

d) a transfer wheel defined by an outer marginal edge, said wheel arranged in coordinated juxtaposed movement with said loader wheel, for receiving the chips from said cavities in said loader wheel and holding said chips against said outer marginal edge of said transfer wheel for subsequent movement therewith;

e) a second inspection means, external said transfer wheel, for viewing the other external surfaces of the chips during their movement on said transfer wheel;

f) computer/processor means for tracking the positions of the chips that have passed and failed the visual inspections by said first and said second inspection means;

g) first removal means for ejecting chips that have failed inspection from said outer marginal edge of said transfer wheel for capture at a location; and, h) second removal means for removing chips that have passed inspection from said outer marginal edge of said transfer wheel for capture in a different location.

29. The visual inspection machine of claim 28 further including a second vacuum means connected to said transfer wheel for providing vacuum power to capture the chips from said cavities on said loader wheel rim and remove them onto said rim of said transfer wheel, when said loader wheel rim and said transfer wheel rim come into coordinated juxtaposed perigee, and for retaining each chip thereafter on said rim of said transfer wheel for inspection by said second inspection means.

30. The visual inspection machine of claim 28 wherein said loader wheel is mounted for rotation about a center shaft and said upper exposed wheel surface, onto which an inventory of individual chips is placed for loading, includes at least one portion thereof that slants downward from said center shaft to said cavities.

31. The visual inspection machine of claim 28 further including a corner chamfer formed on one said side wall of said cavity, said side wall being located nearest the direction of rotation of said loader wheel, for aiding in passing the chip from said inventory into said cavity in a desired orientation.

32. The visual inspection machine of claim 28 wherein said loader wheel and said transfer wheel are in planar arrangement.

33. The visual inspection machine of claim 32 wherein said loader wheel and said transfer wheel are maintained at the same angle to the horizontal.

34. The visual inspection machine of claim 33 wherein said angle is 45°.

35. The visual inspection machine of claim 28 wherein said loader wheel is comprised of a laminate of:

a) an upper wheel defined by an upper surface terminated by an upper wheel rim in which said cavities are formed;

b) a lower wheel defined by a lower wheel rim set inward from said upper wheel rim and forming a partial floor of said cavity so that a chip located in said cavity on said upper wheel rim is only partially supported by said lower wheel adjacent said lower wheel rim and overhangs outward over said lower rim; and, c) wherein said first vacuum means is directed into the lower part of said corner formed between said cavity rear wall and said cavity side wall opposite said chamfer.

* * * * *

UNITED STATES PATENT AND TRADEMARK OFFICE

CERTIFICATE OF CORRECTION

PATENT NO. : 6,294,747 B1 
DATED : September 25, 2001
INVENTOR(S) : Donald Liu, Denver Braden, Romulo V. de Vera, Malcolm Vincent Hawkes and Jose Villafranca Nebres It is certified that error appears in the above-identified patent and that said Letters Patent is hereby corrected as shown below:

Title page,
Item [75], Jose Villafranca Nebres is hereby added as a joint inventor.

Signed and Sealed this

Eleventh Day of June, 2002

*Attest:*

*Attesting Officer*

JAMES E. ROGAN
*Director of the United States Patent and Trademark Office*